US005669541A

United States Patent [19]

Ronconi

[11] Patent Number: 5,669,541

[45] Date of Patent: Sep. 23, 1997

[54] RELEASE MECHANISM WITH SAFETY DEVICE FOR COMPRESSED-AIR NAIL FIRING TOOLS

[75] Inventor: Marco Ronconi, Bologna, Italy

[73] Assignee: Fasco S.p.A., Cadriano Di Granarolo Emilia, Italy

[21] Appl. No.: 601,661

[22] Filed: Feb. 14, 1996

[30] Foreign Application Priority Data

Apr. 19, 1995 [IT] Italy ..... BO95A0174

[51] Int. Cl.[6] ..... B25C 1/04

[52] U.S. Cl. ..... 227/8; 227/130; 91/308

[58] Field of Search ..... 227/8, 130; 91/307, 91/308

[56] References Cited

U.S. PATENT DOCUMENTS 3,583,496 6/1971 Fehrs ..... 227/130

4,436,237 3/1984 Vornberger et al. ..... 227/130

4,550,643 11/1985 Schwartzenberger ..... 227/8

4,915,013 4/1990 Moraht et al. ..... 227/130

*Primary Examiner*—Scott A. Smith

*Attorney, Agent, or Firm*—Guido Modiano; Albert Josif

[57] ABSTRACT

A release mechanism for a compressed-air nail firing tool which includes a trigger that is adapted to act on a pilot valve shutter that activates the nail firing tool. A lever is mounted on the trigger and is operatively associated with a probe that detects the resting position of the nail firing tool on a part being treated. A stem is pivoted on the probe and, in cooperation with a cap that can be applied thereto and as a function of its orientation with respect to the lever, selects single-firing or repeated-firing operation of the nail firing tool.

8 Claims, 3 Drawing Sheets

RELEASE MECHANISM WITH SAFETY DEVICE FOR COMPRESSED-AIR NAIL FIRING TOOLS

BACKGROUND OF THE INVENTION

The present invention relates to a release mechanism for a compressed-air nail firing tool and is particularly adapted for a nail firing tool provided with a head valve.

Conventional nail firing tools used to fire metal nails or staples comprise a hollow body composed of a handle and of a head. A cylinder is formed in the head, and a piston slides inside the head, while the piston is provided with a blade that runs in a channel coaxial to the cylinder. The fixing elements (metal staples or nails) are contained in a magazine lying below the handle and are fed into the channel through a lateral opening. In order to operate the nail firing tool, the cylinder is connected to a compressed-air source through a main valve located in the head and controlled by a pilot valve which is actuated by a trigger-like release mechanism. The trigger acts generally on the shutter of the pilot valve so as to open the main valve and connect the cylinder to the compressed-air source and therefore produce the stroke of the piston, with a consequent expulsion of the fixing element from the channel in which it had been positioned.

It is known that safety reasons require the nail firing tool to be enabled for firing only when it is in contact with the part being treated. This is usually achieved by means of a probe which, when the nail firing tool, or more specifically the outlet of the expulsion channel, is rested on the part being treated, acts on a lever that cooperates with the trigger and the shutter of the pilot valve. Until the probe makes contact with the part, there is no lever movement and the trigger can only be actuated ineffectively.

Nail firing tools are also known that are capable of selectively firing once or several times in succession (repeat operation), depending on the stroke made by the actuation trigger. Other nail firing tools are capable of firing several times in succession when the trigger is actuated continuously and the probe is repeatedly pressed against the part being treated. This system, which allows skilled operators to use the nail firing tool as if it were an automatic nailer, is normally termed "hammer firing".

When the nail firing tool is set for single-fire operation, rebound phenomena due to the recoil on the part can cause accidental repeat activation of the nail firing tool, with severe danger for nearby people.

Moreover, it has been observed that when the nail firing tool is preset for repeat operation, there is a condition of severe danger, especially if the nail firing tool is handled by inexperienced individuals. Actually, inexperience causes many people to fail to correctly realize how much power these tools are capable of producing. For such individuals, it is often difficult, if not impossible, during hammer operation, to neutralize the recoils and rebounds of the nail firing tool on the part, with the consequence that the user loses control of the nail firing tool, which can involuntarily fire a plurality of fixing elements.

In such cases, it would be desirable to provide two safety levels in the operation of the nail firing tool, so that when it is used for single firing, hammer operation is assuredly disabled and restoring it requires conscious intervention by the user, who can thus be prepared to deal with a more demanding operation.

SUMMARY OF THE INVENTION

Accordingly, a principal aim of the present invention is to provide a release mechanism that allows to switch the nail firing tool from single-firing to hammer operation with an action entailing a voluntary act by the user not limited to the simple gesture of controlling the stroke of the trigger.

A particular object of the present invention is to provide a release mechanism through which the conversion of the nail firing tool from single-firing to hammer operation depends on the presence of an additional removable mechanical element which, if removed, allows to market the nail firing tool in the configuration that ensures the safest operating mode, namely, single firing.

Another object of the present invention is to provide a release mechanism that is simple in concept and safely reliable, even in view of the rough treatment to which said tools are subjected during use.

In accordance with one preferred embodiment of the invention, there is provided a release mechanism for a compressed-air nail firing tool provided with a probe adapted to perform a stroke between a firing tool disabling position and a firing tool enabling position while resting on a part being treated, and with a trigger adapted to act on a pilot valve shutter for activating the nail firing tool when the probe is in the enabling position. The release mechanism includes a slider element, which is associated with the probe and is guided so as to follow its movement while the nail firing tool rests on the part, and a lever which is pivoted to the trigger and has one end which rests on the slider in the probe disabling position. The lever is operatively associated with the shutter so that, when the probe is in the disabling position, the actuation of the trigger is not sufficient to move the lever into the position for activating the pilot valve, whereas when the probe moves into the enabling position the slider element causes a partial oscillation of the lever such that, when the trigger is subsequently actuated, there is an actuation stroke of the pilot valve shutter, at the end whereof the lever disengages from the slider and from the shutter to return to the position for deactivating the nail firing tool. The release mechanism further includes a stem articulated to the slider element, and an extension cap which is applicable to the stem and is movable by the user between a passive position, that corresponds to the single-firing position of the nail firing tool, and an active position, in which the stem, by virtue of the cap applied thereto, abuts against the lever, so as to keep it constantly operatively engaged with the shutter when the probe is in the enabling position and the trigger is pressed to allow repeated operation of the nail firing tool.

BRIEF DESCRIPTION OF THE DRAWINGS

The particular characteristics and advantages of the invention will become apparent from the following detailed description of a preferred embodiment thereof, described herein and illustrated in the accompanying drawings only by way of non-limitative example, wherein.

DESCRIPTION OF THE PREFERRED EMBODIMENTS

Figure 1:
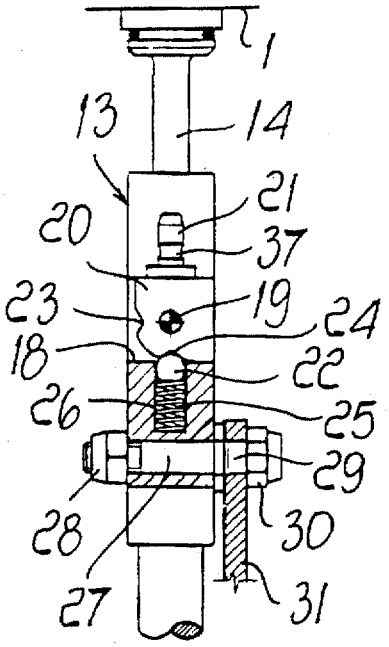
FIG. 1 is a rear view of a preferred embodiment of the release mechanism according to the invention in a single-firing condition.

In the figures, the reference numeral 1 designates the handle of a conventional nail firing tool as described previously, adapted to operate by single firing or by repeated firing, depending on the position of a pilot valve that is accommodated in a seat of the handle located behind the head of the nail firing tool that accommodates the cylinder in which the piston with the striking blade slides. As regards the pilot valve, which is not shown in detail since it is fully conventional, only the end of the shutter 2 is shown, on which the release mechanism 3 that actuates the expulsion of the fixing elements, for example nails, acts. More specifically, if the release mechanism acts momentarily on the shutter, a single nail is expelled. If the trigger remains in the activation position, small movements of the probe might cause the repeated actuation of the shutter, with the result of firing a plurality of fixing elements.

The release mechanism 3 comprises a trigger 4 articulated below the handle 1 by means of a pivot 5 and is constituted by a U-shaped element with two parallel wings 6 that are connected by a portion 7 substantially perpendicular to the wings. The wings 6 are provided with a protrusion 8 adapted to abut below the handle when the trigger is pressed by the user. A spring 9 acts on the wings 6 and is fixed to the body of the nail firing tool, biasing the trigger 4 to keep it spaced from the shutter 2 when the trigger is not pressed by the user.

The trigger has a curved end to ensure better engagement of the user's finger during actuation, and has a recess 10 formed between the wings 6 and the edge of the portion 7 lying opposite to the end of the trigger 4.

A lever 11 is arranged between the wings 6 and above the portion 7 and is articulated to the wings 6 about a pivot 12 which extends parallel to the pivot 5. The lever 11, when the nail firing tool is idle, protrudes above the recess 10 and is kept resting on the portion 7 by a coiled spring 10*a*. The free end of the lever 11 is adapted to abut against the top of a slider 13 guided along a shaft 14 that protrudes from the handle 1 along an axis A that is parallel to the sliding axis of the striking blade.

The slider 13 comprises two sleeve portions 15 and 16 slideable on an enlarged portion of the shaft 14 and rigidly connected to each other by a bridge 17. The slider 13 is prevented from rotating about the shaft 14 and is arranged angularly below the trigger 4, so as to remain aligned with the recess 10. A slot 18 is formed in the bridge 17 and constitutes a seat in which a circular cam sector 20, provided with a radial stem 21, is articulated by means of a pin 19.

The cam 20 is rotatable on a plane that lies at right angles to the oscillation plane of the trigger 4 between two positions that are offset by 90°. In one of these positions, shown in FIGS. 1 to 6, the stem 21 is parallel to the shaft 14, and its top lies below the level of the upper edge of the sleeve 15. In the other position, the stem 21 is tilted laterally at right angles to the shaft 14.

The retention of the stem 21 in either of these two positions is determined by the engagement of a ball 22 in one of two notches 23 and 24 formed in the peripheral region of the cam 20 and offset by 90° with respect to the pin 19. The ball 22 is loaded by a spring 25 and is accommodated, together with said spring, in a blind hole 26 formed in the bridge 17 through the bottom of the slot 18. The ball 22, by virtue of the spring 25, can act on the peripheral region of the cam 20 and engage the notch 23 or 24, so as to perform a merely elastic retention of the stem 21 and allow to orientate it at right angles, or parallel, to the shaft 14.

A bolt 27 is driven through the bridge 17, below the hole 26, lies at right angles to the pin 19, and is fixed by a nut 28. The bolt 27 has a threaded tang 29 on which a rod 31 is fixed by means of a nut 30; said rod extends parallel to the shaft 14 and is provided with a conventional probe at its end. When the hailer is inactive, the probe is arranged below the nail expulsion channel so that, by resting the nailer on the part, the probe moves and therefore the slider 13 moves towards the handle 1.

Figure 7:
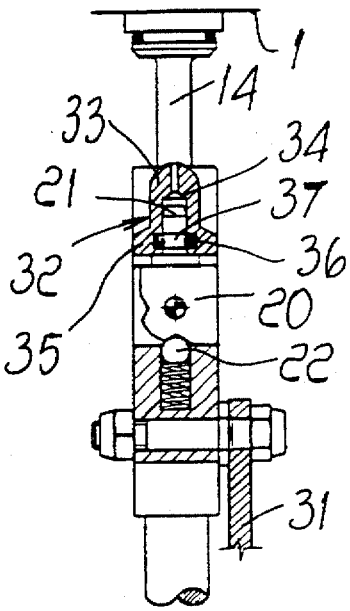
FIG. 7 is a rear view of the release mechanism of the preceding figures in a hammer operating condition.
Figure 8:
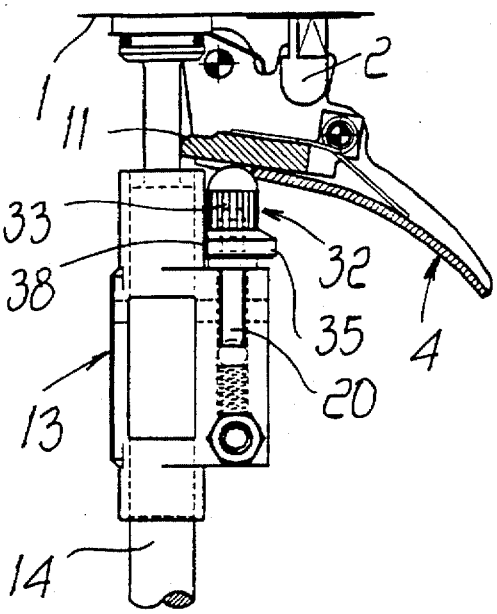
FIG. 8 is a side view of the mechanism of FIG. 7.

A cap 32 (see FIGS. 7 and 8) can be detachably applied to the stem 21 and is composed of a bush 33 through which an axial through hole 34, adapted to receive the stem 21, passes.

The bush 33 has, on the side for inserting the stem 21 in the hole 34, a flange 35 the diameter whereof is at least equal to the thickness of the bridge 17, to ensure that the flange is engaged by the fingers of one hand during the operations for applying the cap 32 on the stem 21 and for removing it from said stem.

In order to retain the cap 32 on the stem 21, an elastic ring 36 is provided inside the bush 33 and is adapted to engage an annular groove 37 of the stem 21.

The cap 32 is completed by a flattened region 38 of the flange 35, which allows the stem 21 to rotate in a position that is parallel to the shaft 14 only when the flattened region 38 is parallel to the rotation plane of the stem 21.

In all the other angular positions of the cap 32, the flange 35 strikes against the sleeve 15 and blocks the rotation of the stem 21. The operation of the described release mechanism 1 is as follows.

Figure 2:
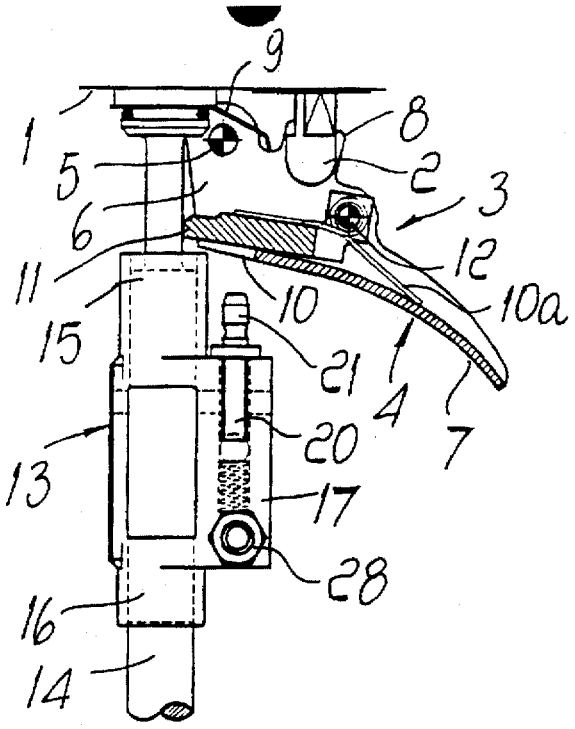
FIG. 2 is a side view of the mechanism of FIG. 1.
Figure 3:
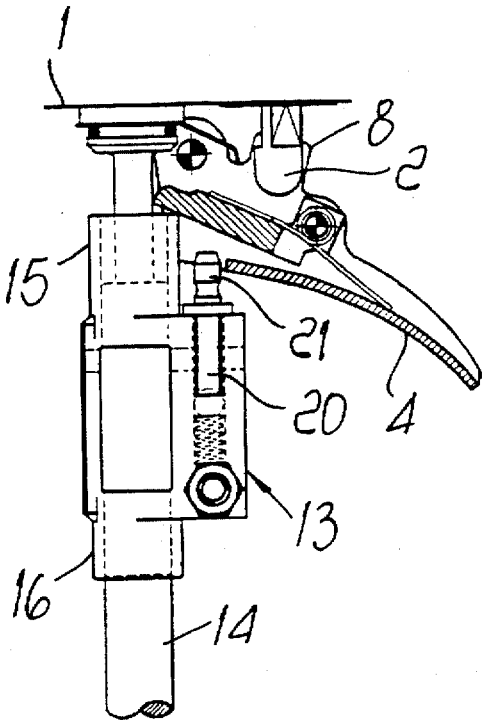
FIG. 3 is a side view of the mechanism of FIG. 1 just before a single-firing action.
Figure 4:
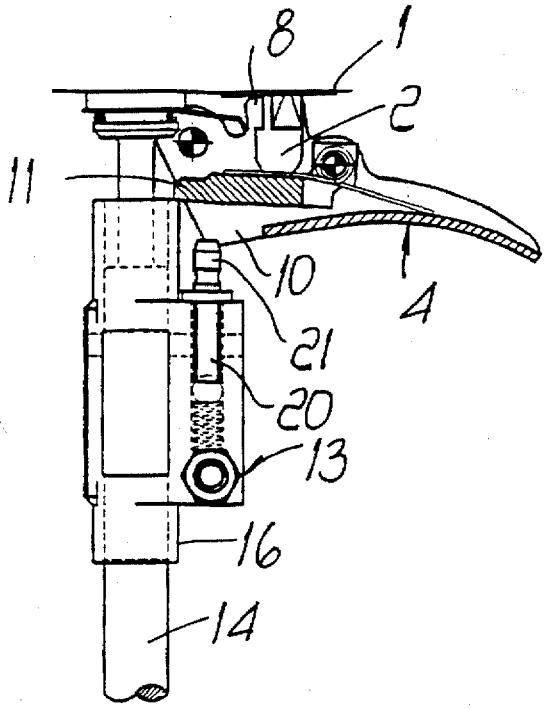
FIG. 4 is a side view of the mechanism of FIG. 1 during firing.
Figure 5:
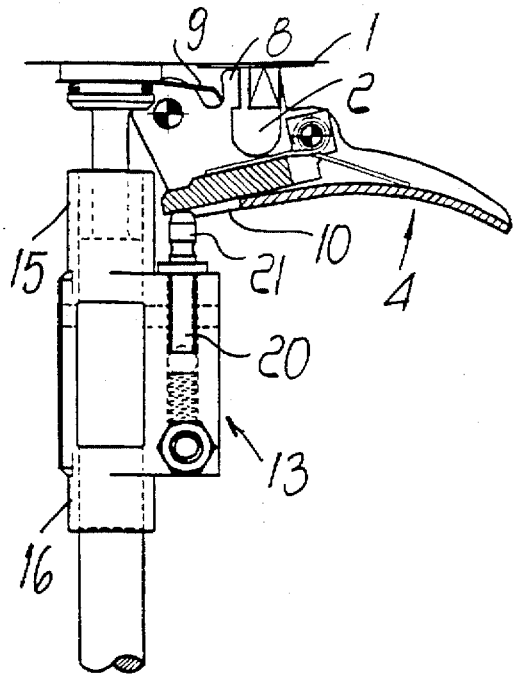
FIG. 5 is a side view of the mechanism of FIG. 1 just after the single-firing action.
Figure 6:
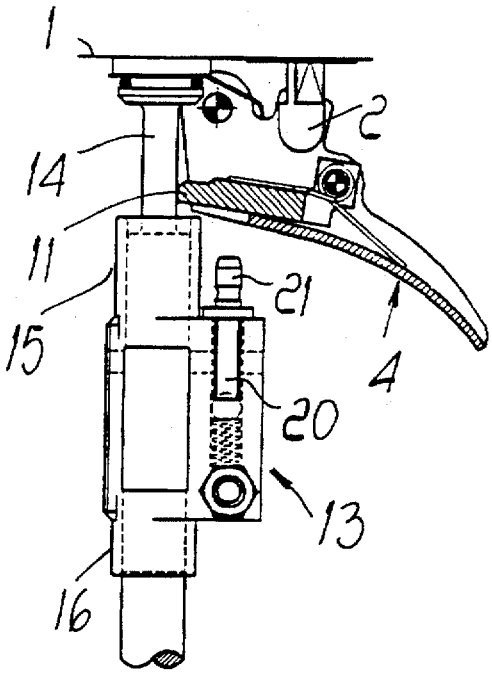
FIG. 6 is a view of the mechanism of FIG. 1 in a recocking position, just after a single firing.

During single-firing, the orientation of the stem 21 is irrelevant, when the cap is not applied to the stem. Assume, for example, that the stem 21 is orientated parallel to the shaft 14, as shown in FIGS. 1 and 2. In this situation, when the gun is placed on the part (FIG. 3), the probe is moved so as to cause the sliding of the rod 31 and of the slider 13 on the shaft 14. The sleeve 15, by sliding on the shaft 14, acts below the lever 11, lifting it in contrast with the action of the spring 11.

At this point, by acting on the trigger 4, the lever 11 presses on the shutter 2 (FIG. 4), which is moved into the position in which the compressed air can enter the cylinder and actuate the piston to expel the nail. However, just before the tooth 8 abuts against the handle 1, the lever 11, due to the thrust of the spring 10*a*, stops resting on the sleeve 15, allowing the shutter 2 to protrude from the handle and return the pilot valve to the compressed-air cutoff position, in which additional firing is prevented even if the probe remains pressed on the part (see FIG. 5) or the trigger is pressed repeatedly.

Figure 9:
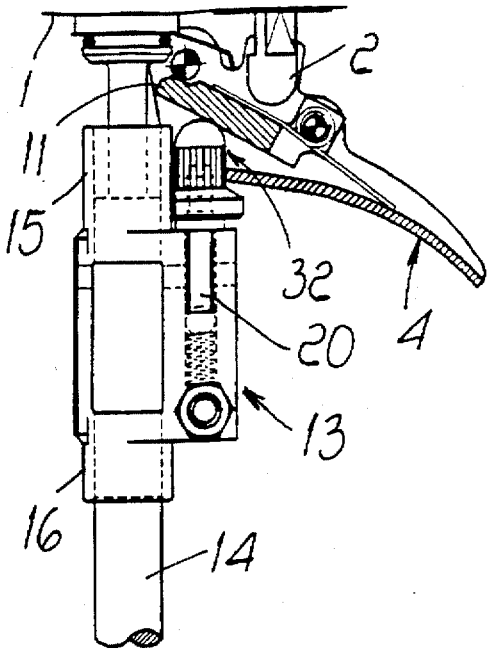
FIG. 9 is a view of the mechanism of FIGS. 7 and 8 just before hammer firing, with the probe pressed onto the part to be treated.
Figure 10:
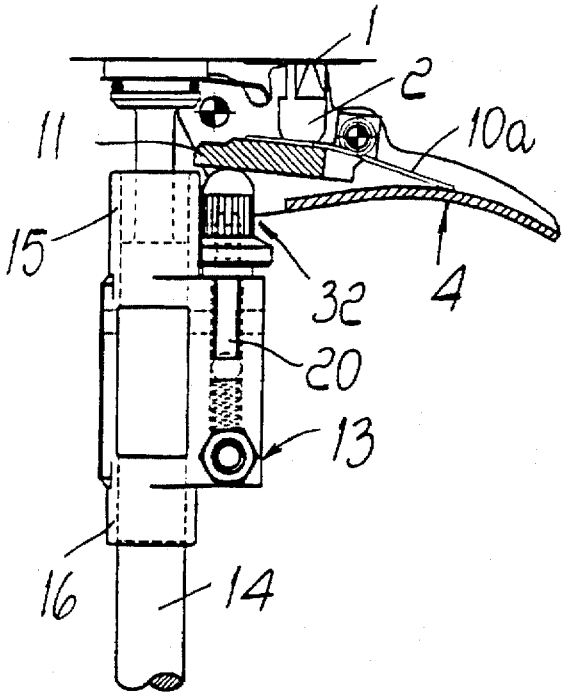
FIG. 10 is a view of the mechanism of FIG. 7 during hammer firing.
Figure 12:
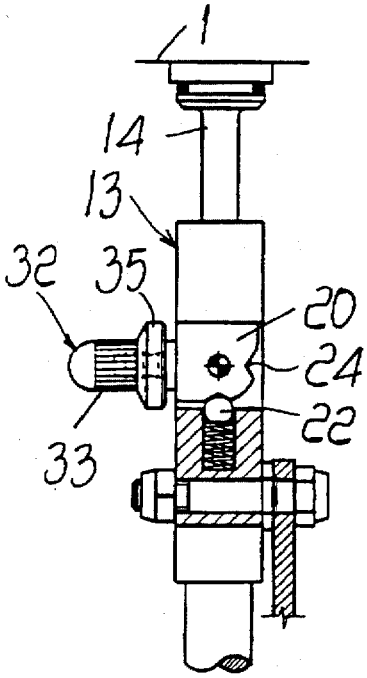
FIG. 12 is a rear view of the release mechanism of FIGS. 7 to 11 in a single-firing position.

A prerogative of the invention is the fact that the insufficient length of the stem 21 prevents said stem from making contact with the lever 11 and allowing repeated operation of the nail firing tool. In order to preset said repeated operation, it is necessary to extend the stem 21 by applying the cap 32, and this forces the user to be aware of the fact that the nail firing tool is being preset for a kind of operation requiring greater caution. The cap 32 is applied more comfortably by keeping its stem at right angles to the shaft 14 (FIG. 12). Then, by overcoming the retention force of the ball 22 in the notch 23, the stem 21 is turned into a position that is parallel to the shaft (FIGS. 7 and 8), and this position is maintained by the engagement of the ball in the notch 24. When the slider is lifted, as a consequence of placing the firing tool on the part (FIG. 9), the lever 11 continues to rest on the top of the cap 32. In this condition, when the trigger is pressed (FIG. 10), the lever 11 can no longer descend, since it constantly rests on the top of the cap and the shutter 2 remains retained in the repeated nail firing position.

Figure 11:
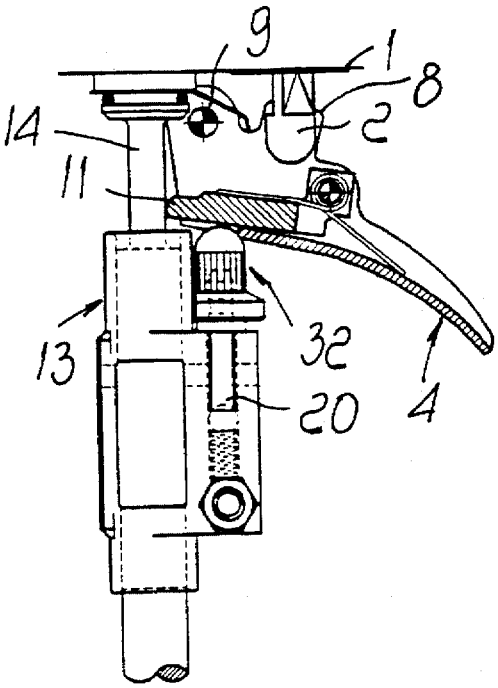
FIG. 11 is a view of the release mechanism of FIG. 7 just after a hammer firing.

Nail expulsion is interrupted by releasing the trigger 4, so that the shutter 2 can resume the original idle position (FIG. 11).

It is evident that a substantial advantage of the invention is a greater operating safety, since when the release mechanism is preset for single firing and fixed by removing the cap 32, it is not possible to cause repeat firing, since the stem 21 no longer cooperates with the lever 11 both in case of rebound phenomena, to which the gun is subjected during use, and due to involuntary impacts caused by the users.

The same result is obtained by leaving the cap 32 on the stem 21 but turning it at right angles to the shaft 14 (FIG. 12). In this case, the cap is appropriately turned on the stem 21, so that the flattened region 38, by no longer being tangent to the sleeve 15, allows the flange 35 to interfere with the sleeve 15 and prevent the accidental return of the cap below the lever 11 in the repeated operation position.

The invention thus conceived is susceptible to numerous modifications and variations, all of which are within the scope of the inventive concept.

All the details may furthermore be replaced with other technically equivalent ones.

In practice, the materials employed, as well as the shapes and the dimensions, may be any according to the requirements without thereby abandoning the scope of the protection of the claims that follow.

What is claimed is:

1. A release mechanism for a compressed-air nail firing tool provided with a probe that is adapted to perform a stroke between a firing tool disabling position and a firing tool enabling position while resting on a part being treated, and with a trigger adapted to act on a pilot valve shutter for activating the nail firing tool when the probe is in the enabling position; the release mechanism comprising: a slider element, associated with said probe and guided so as to follow its movement while the nail firing tool rests on the part; a lever, pivoted to said trigger and having one end which rests on said slider in the probe disabling position, said lever being operatively associated with said shutter so that, when the probe is in the disabling position, the actuation of the trigger is not sufficient to move the lever into the position for activating the pilot valve, whereas, when the probe moves into the enabling position, the slider element produces a partial oscillation of said lever such that, when the trigger is subsequently actuated, there is an actuation stroke of the pilot valve shutter, at the end whereof said lever disengages from the slider and from the shutter to return to the position for deactivating the nail firing tool; a stem being articulated to said slider element; and an extension cap being applicable to said stem and being movable by the user between a passive position, that corresponds to the single-firing position of the nail firing tool, and an active position, in which the stem, by virtue of said cap applied thereto, abuts against said lever, so as to keep it constantly operatively engaged with said shutter when the probe is in the enabling position and said trigger is pressed to allow repeated operation of the nail firing tool.

2. A release mechanism according to claim 1, wherein said slider has a bridge-shaped portion in which a seat is formed for accommodating a cam, to which said stem is radially rigidly coupled, said cam being provided with two peripheral notches that can be engaged by an elastically loaded ball, said notches being angularly offset so as to retain said stem in said active or passive position.

3. A release mechanism according to claim 1, wherein said cap comprises a bush that can be inserted on said stem and is adapted to be retained thereon by an internal elastic ring adapted to engage in a groove of said stem.

4. A release mechanism according to claim 3, wherein said bush has a flange provided with a flattened region and adapted to abut with parts of said slider and prevent the orientation of said stem in said active position, except when said flattened region is co-planar to the rotation plane of said stem.

5. A release mechanism for a compressed-air nail firing tool which includes a pivoting trigger for activating a pilot valve shutter and a sliding probe for allowing the trigger to activate the shutter when the probe contacts, in an activation configuration, a part to be treated by the firing tool, the release mechanism comprising:

a slider connected with said sliding probe;

a lever pivoted to said trigger for activation engagement with said shutter and being spring biased in a direction for making contact with said slider;

a stem rotatably supported by said slider and movable into at least two releasably fixed positions;

a cap portion connected with said stem such that said cap portion makes contact with said lever instead of said slider when said probe is in said activation configuration and when said stem is in one of said fixed positions, and such that said slider makes contact with said lever when said stem is in another of said fixed positions and said probe is in said activation configuration.

6. A release mechanism according to claim 5, wherein said cap portion is rotatably connected to said stem and includes a flat portion for mating with a corresponding flat face of said slider depending upon the rotated position of said cap portion.

7. A release mechanism according to claim 6, wherein said cap portion is removably associated with said stem.

8. A release mechanism according to claim 5, wherein one face of said lever is adapted for engaging said pilot valve shutter and another face of said lever is adapted for engaging one of said cap portion and said slider depending on the rotated position of said stem.

* * * * *